US005238370A

United States Patent [19]

DiFlora

[11] Patent Number: 5,238,370

[45] Date of Patent: Aug. 24, 1993

[54] COMPRESSOR SUCTION GAS FEED AND NOISE ATTENUATOR ASSEMBLY

[75] Inventor: Michael A. DiFlora, Briston, Tenn.

[73] Assignee: Bristol Compressors

[21] Appl. No.: 672,208

[22] Filed: Mar. 19, 1991

[51] Int. Cl.[5] ..... F04B 39/00

[52] U.S. Cl. ..... 417/312; 181/403; 181/269

[58] Field of Search ..... 417/312, 313; 181/403, 181/240, 227, 269, 273

[56] References Cited

U.S. PATENT DOCUMENTS

| | | | |
|---|---|---|---|
| 3,509,907 | 5/1970 | Gannaway | 417/312 |
| 4,105,374 | 8/1978 | Scharf | 417/312 |
| 4,236,092 | 11/1980 | DiFiora | 310/68 C |
| 4,410,303 | 10/1983 | Bar | 417/312 |
| 4,412,791 | 11/1983 | Lal | 417/312 |
| 4,534,861 | 8/1985 | Wedemeyer | 417/312 |
| 4,582,468 | 4/1986 | Bar | 417/312 |
| 4,591,318 | 5/1986 | Elson | 417/312 |
| 5,164,552 | 11/1992 | Pandeya et al. | 181/403 |

*Primary Examiner*—Richard A. Bertsch
*Assistant Examiner*—Peter Koryinyk

[57] ABSTRACT

A suction gas feed assembly for a gas compressor unit having a shell, an electric motor driven dual piston compressor mounted therein having dual suction ports, one end of the motor being interconnected with and adjacent the compressor, the other end of the motor being substantially unencumbered, the feed assembly consisting of an end cap having a circumferential side wall and a top wall and adapted to be mounted within the shell with the side wall in substantial sealing contact with the unencumbered end of the motor to provide a suction plenum substantially containing the unencumbered end, dual suction conduits each having one of its ends mounted in an aperture in the side wall of the end cap, the apertures being spaced apart on the side wall a distance of at least about one eighth the total circumferential dimension of the side wall, the other ends of the conduits adapted to be mounted in communication with the suction porting of the compressor, intermediate portions of each of the conduits lying in contiguous relationship, a housing surrounding the intermediate portions and spaced therefrom to provide a substantially closed attenuator cell containing the intermediate portions, and gas passages in each of the intermediate portions placing each of the conduits in fluid communication with the cell.

20 Claims, 3 Drawing Sheets 60
62a
64a
62
64
65
59
60
106
14
110
100
54
55
108
100
78
39
68
82
76
80
70
73
84
76
82
80
41
70
64
104
48
18
50
14
102
56
10
26
32
4
56
12
38
36
94
28
22
a
26
92
30
36
32
34
54
55
24
10

5
96
106
27
51
20
58
54
56
92
42
52
38
72
88
86
90
86
92
67
66
69
74
98
55
58
53
10
4
56
40
16
46
12
44
93
52
92
12
38
36
94

COMPRESSOR SUCTION GAS FEED AND NOISE ATTENUATOR ASSEMBLY

FIELD OF INVENTION

This invention concerns novel construction for suction gas feed systems and particularly concerns such feed systems having noise attenuation capacity for reducing suction noise resulting from suction conduit vibration, valving operation, suction gas pulsing, or the like, of piston type compressors such as hermetically sealed units used in refrigerators, heat pumps, window units, or other such applications, and particularly concerns such feed systems and noise attenuation for use with dual piston compressors employing dual suction valving and dual suction gas feed conduit means.

DESCRIPTION OF RELATED ART

Suction gas feed systems for piston type gas compressors often employ a suction gas intake plenum or chamber over the motor end, from which conduits or rotor gap convey the gas to the intake mechanism such as suction valving for the cylinders. Such systems are shown in U.S. Pat. Nos. 4,105,374; 4,174,189; 4,236,092; 4,239,461; 4,412,791; 4,503,347; and 4,591,318. Also, the use of noise attenuators which are mounted in-line in the suction conduit systems of hermetically sealed compressor units is of course well known as shown in U.S. Pat. Nos. 3,101,891; 3,645,358; 3,864,064; and 4,239,461, the utility disclosures of which are incorporated herein by reference.

It has been applicants' experience however, that the particular constructions of the intake plenums, the suction mufflers, and the various combinations thereof shown in these prior patents do not give the degree of noise attenuation which applicant considers necessary for his applications. Also, many of the prior devices are structurally complex and costly in manufacture and assembly into the compressor intake system.

Objects, therefore, of the present invention are: to greatly simplify the construction and assembly procedures for suction gas plenum and noise attenuators in compressors, particularly in small hermetically sealed, dual piston units, while providing markedly improved noise muffling; and to provide a suction gas feed assembly of improved noise attenuation wherein the suction gas plenum is not required to be altered in configuration from those already in use.

SUMMARY OF THE INVENTION

These and other objects hereinafter appearing have been attained in accordance with the present invention through the discovery of a suction gas feed assembly for a gas compressor unit having shell means, electric motor driven dual piston compressor means mounted therein having dual suction porting means, one end of the motor being interconnected with and adjacent the compressor means, the other end of the motor being substantially unencumbered, said feed assembly comprising end cap means having circumferential side wall means and top wall means and adapted to be mounted within the shell means with said side wall means in substantial sealing contact with the said unencumbered end of the motor to provide suction plenum means substantially containing said end, dual suction conduit means each having one of its ends mounted in aperture means in said side wall means of said end cap means, said aperture means being generally circumferentially spaced apart on said side wall means a distance of at least about one eighth the total circumferential dimension of said side wall means, the other ends of said conduit means adapted to be mounted in communication with the suction porting means of the compressor, intermediate portions of each of said conduit means lying in contiguous relationship, housing means surrounding said intermediate portions and spaced therefrom to provide substantially closed attenuator cell means containing said intermediate portions, and gas passage means in each of said intermediate portions placing each of said conduit means in fluid communication with said cell means.

In certain preferred embodiments:

(a) said aperture means are spaced apart from about $\frac{1}{4}$ to about 1/7 of said circumferential dimension;

(b) the ratio of the net volume of the suction plenum means, i.e., total volumetric capacity thereof minus the volume occupied by the stator and rotor ends which project into the plenum, in $cm^3$, to the total average cross-sectional area of both said conduit means in $cm^2$ is from about 200 to about 400, more preferably from about 250 to about 350, and most preferably from about 275 to about 325;

(c) said housing means comprises a single jacket means containing the intermediate portions of both said conduit means;

(d) said cell means is continuous; and (e) the ratio of the total volume of said suction plenum in $cm^3$ to the total volume in $cm^3$ of both said suction conduit means is from about 8 to about 30, more preferably from about 12 to about 25, and most preferably from about 14 to about 18.

BRIEF DESCRIPTION OF THE DRAWINGS

The invention will be understood further from the following description and drawings wherein.

DESCRIPTION OF PREFERRED EMBODIMENTS

Figure 1:
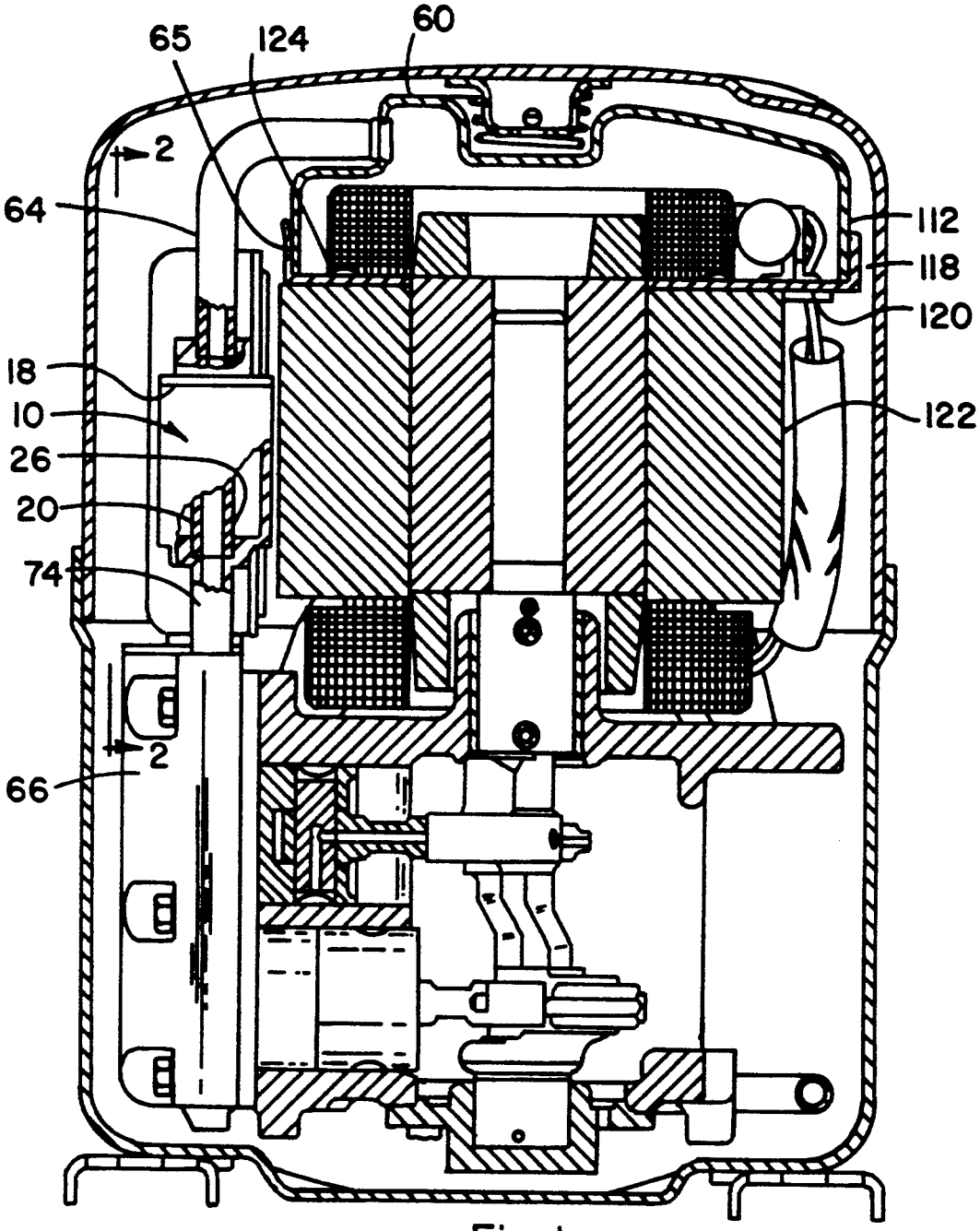
FIG. 1 is a cross-sectional view of a typical dual cylinder, hermetically sealed compressor unit provided with the present suction gas plenum and a preferred noise attenuator installed in the dual suction conduit system thereof.

Referring to the drawings, the attenuator comprises an elongated, tubular body means 10 having a base end 12 and a closure end 14, base cap means 16 on the base end, closure cap means 18 on the closure end both of said cap means and said body means providing housing means defining an elongated, substantially closed attenuation cell means generally designated 20 and having major and minor transverse axes, 22 and 24 respectively, oriented substantially normally to each other, elongated wave modulating barrel means 26 projecting from the inner side 27 of said closure cap means and having major and minor transverse axes 28 and 30 respectively, oriented substantially normally to each other, said barrel means being positioned within said cell means 20 substantially longitudinally thereof with the major axis 28 of said barrel means being angularly offset from the major axis 22 of said cell means and substantially dividing said cell means into elongated, substantially equal volume halves 32 and 34, socket means 36 receiving the distal end portion 38 of said barrel means and being formed in the interior surface 40 of said base cap means and defined by floor means 42 and sealing wall means 44 surrounding the same and extending generally normally therefrom, sealing surface means 46 on the distal end portion 38 of said barrel means engaging said sealing wall means and forming a fluid seal therebetween, mating sealing shoulder means 48 and 50 respectively on said closure end of said body means and said closure cap means and forming a fluid seal therebetween, port means 52 formed in said base cap means and extending through said floor means, gas passage means 54, 55 formed in said closure cap means and barrel means generally longitudinally thereof, said port means and passage means being in fluid communication across said floor means, and damping vent means 56 in the wall 58 of said barrel means placing each said passage means into restrictive fluid communication with each half of said cell means.

As shown, (1) the compressor motor cap or suction gas plenum 60 has circumferential side wall means 61 and top wall means 63. The dual suction tubes 62 and 64 are swedged or brazed at 62(*a*) and 64(*a*), (2) the compressor head 66 or other suction gas inlet or porting structure is provided with suction channels 67, 69 formed therein, and (3) the passages 54 and 55 provided by the intermediate portions 51 and 53 respectively of the suction tubes which lie within the cell means 20, provide the dual suction gas conduit means into or onto which the attenuator is provided. For this purpose, conduit pair segments 68, 70 and 72, 74 are provided on closure cap means 18 and base cap means 16 respectively. Either or both of suction tubes 62 and 64 may be provided with a shoulder such as 76 to limit the insertion of the tubes into the conduit segments 68 and 70 to insure proper relative positioning of the attenuator in the suction conduit system. These tubes and conduit segments are dimensioned to provide substantially gas-tight frictional connection and for that purpose, a peripheral ring or ridge such as shown as 86 for segments 72, 74 may be provided on the tubes to assist in making a compressed, tight, sliding fit. It is noted that as shown in the drawing, the sleeves 78 and 80 of the conduit segments 62, 64 preferably are slightly tapered inwardly to provide sealing face means 39, 41 which tightly receive the larger diameter insertion end portions 82, 84 of the suction tubes. Periperal rings such as 86 provided on segments 72, 74 assist in frictional sealing in wells 88 and 90 respectively in the compressor head or contiguous intake structure.

As stated above, the spacing of the suction tubes 62 and 64 on the circumferential wall means 61 should be at least about ⅛ the total maximum length or circumference of wall means 61 as measured around the lower portion 65 of the end cap. As shown in the drawing, the spacing is about one sixth the circumference of 61. The preferred spacing ranges from about one seventh to about one third of said circumference. The combination of the configuration, dimensions, and arrangements of cap 60, tubes 62 and 64, the attenuator housing which jackets the contiguous portions of tubes 62 and 64, and the open suction inlet 71 in the cap wall provides the markedly improved noise attenuation of the present feed assembly, while providing good suction gas flow rate. The ratio of the flow area in $cm^2$ of inlet 71 to net plenum volume in $cm^3$ (as defined above) is preferably from about $0.9\times10^{-2}$ to about $2.0\times10^{-2}$, more preferably from about $1.25\times10^{-2}$ to about $1.75\times10^{-2}$, and most preferably from about $1.4\times10^{-2}$ to about $1.6\times10^{-2}$.

An important feature of the particular embodiment of the present invention shown in the drawing resides in the configuration of the mating sealing shoulder means 48 and 50 of the body and closure cap, in combination with the configuration and dimensioning of the socket means 36 and barrel means 26 and its distal end portion 38. The unique construction and assembly procedure for the illustrated preferred embodiment of the attenuator requires the substantially simultaneous formation of two permanent and important fluid-tight seals, i.e., the closure cap onto the body end, and the distal end portion of the barrel means into the base cap means.

To insure such sealing it is preferred that the length of barrel means 26 be such that it does not bottom out against the floor means 42 as the sealing surface 50 of the closure cap is forced tightly against sealing surface 48 on the body end. Such being the case, the sealing surface means 46 on the periphery of the distal end portion 38 of the barrel is dimensioned such that it can be forced into the socket means 36 and seal against the smaller periphery sealing wall means 44. In order to allow such forcing, a chamfer or curved surface 92 of suitable dimension is provided on the entry portion 93 of the sealing wall means to angularly contact the barrel end and direct it in a compressive manner into the socket means.

Figures 2, 3, 4, 5:
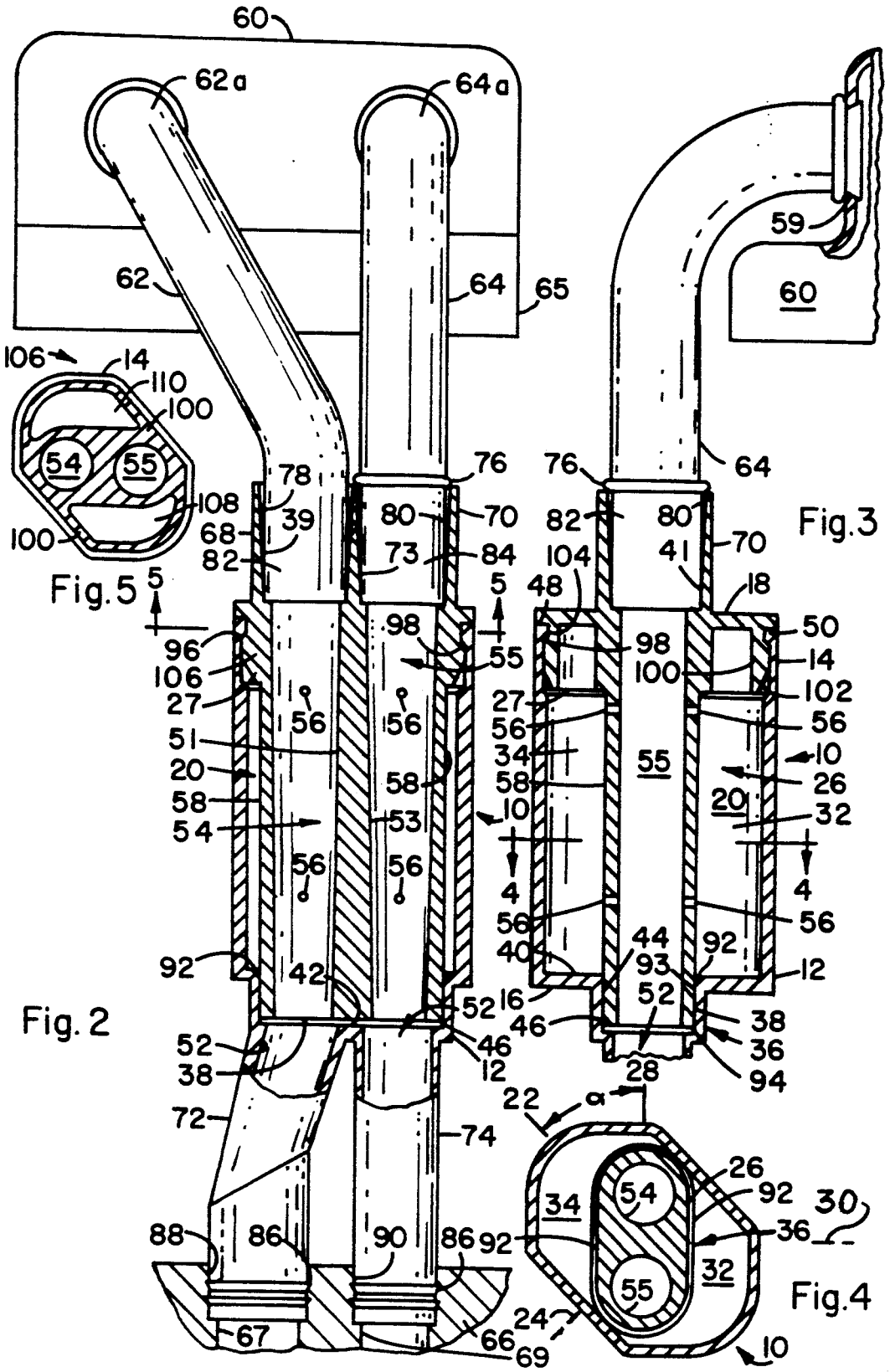
FIG. 2 is an enlarged longitudinal sectional view of the preferred attenuator of FIG. 1 viewed in the direction of arrow 2, with contiguous other compressor unit portions shown.
FIG. 3 is a view as in FIG. 2 rotated clockwise 90 degrees.
FIG. 4 is a cross-sectional view taken along line 4—4 of FIG. 3 in the direction of the arrows.
FIG. 5 is a cross-sectional view of the structure of FIG. 2, taken along line 5—5 thereof in the direction of the arrows.
Figure 8:
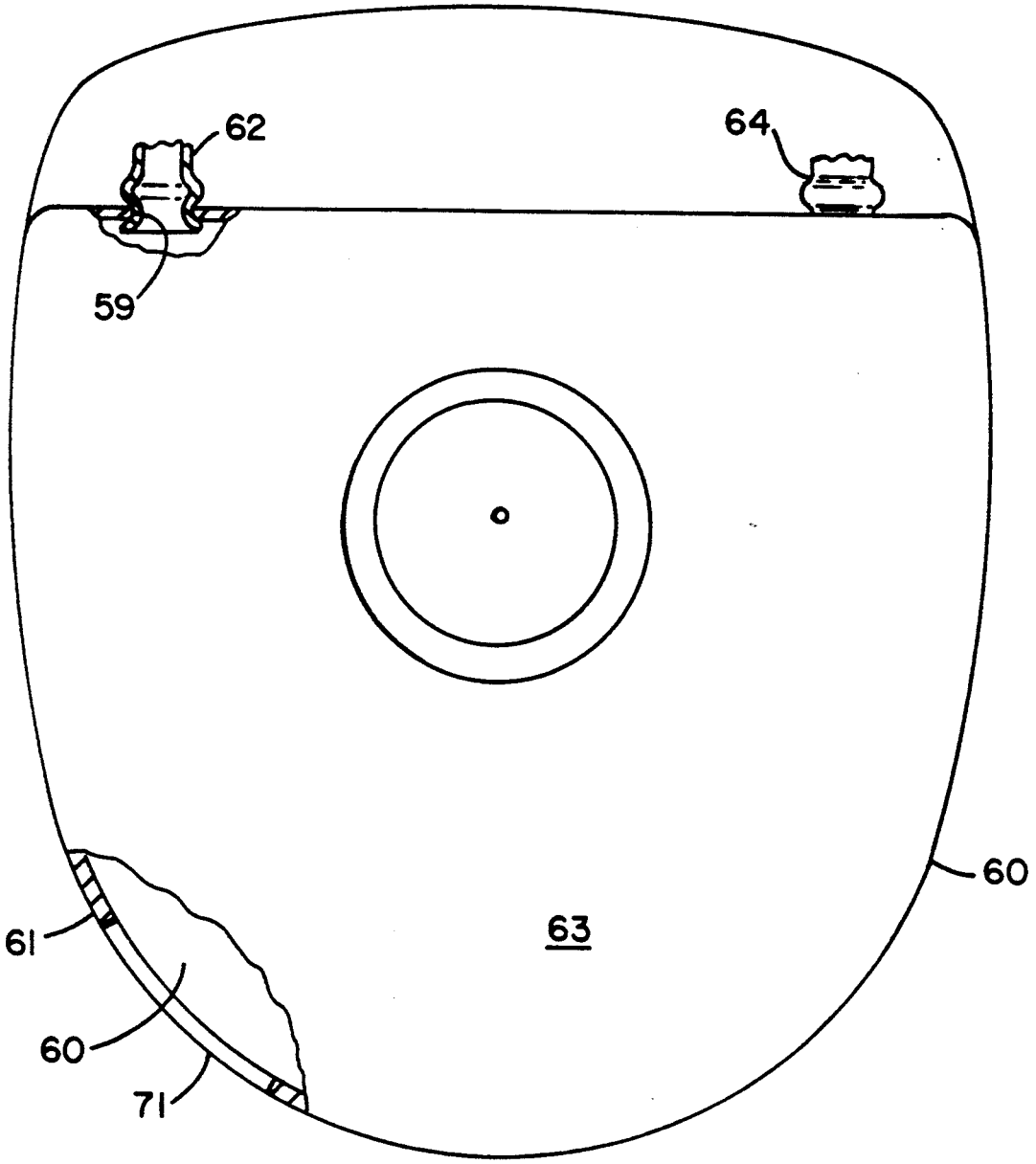
FIG. 8 is a top view, partly in section, of the motor cap.

In concert with the formation of these seals, it is preferred that a mechanism be provided to both lock the closure cap means, barrel means and body means tightly together, and to assist in the actual formation and maintenance of the seals. This is accomplished by the provision of cooperating cam means 96, 98 on the closure cap and body end respectively, which cam means engage after the semi-flexible wall 100 is inserted into the body end with the aid of an angled periphery 102 which slides and is forced resiliently inwardly over lip 104 of the body end. The engagement of these cam surfaces 96, 98 generates a force vector directed generally longitudinally of the body which maintains a high degree of integrity in the closure cap/body seal, and in the barrel end/socket means seal. With reference to FIG. 5, the necessary flexibility and resiliency of wall 100 for providing the caming action of 96, 98 is achieved by forming the closure cap body portion 106 with large cavities 108, 110 which gives a proper wall thickness of wall 100 to impart the necessary resiliency thereto.

The angular orientation of the major axes 22 and 28 of the cell and barrel respectively, especially the approximate 40 degree–50 degree angle shown, wherein cell halves 32 are at least substantially isolated, has been found to maximize the noise attenuation while minimizing the thickness of the attenuator body, which combination is especially important in small, sealed compressor units wherein space is at a premium.

A particularly significant structural feature is the constant intercommunication of each of the conduit passages 54, 55 with each half of the cell by way of damping vents 56. It appears that enhancement of the noise reduction achieved by the present attenuator results at least partially from use of the directionally opposite or non-resonant wave formation effected by operation of the multiple suction chambers and valving of the compressor. Wave dislocation rather than reinforcement appears to result from the use and location of damping vents 56. In this regard, the vent size and number can be widely varied to maximize the muffling for a particular compressor capacity and design.

For the particular embodiment shown in the drawings, a typical set of vents of 0.050 inch diameter located adjacent the top and bottom of barrel 26 in equal numbers is eight, and a typical total volume of the cell halves is about 1.3 in.$^3$.

Typically, the vent size, number and location are determined by a combination of factors including the attenuator cell volume, suction gas velocity through the attenuator conduits and passages, the frequency bands to be attenuated, and suction gas temperature, or the like.

In the embodiment shown in the drawings, the ratio of the length of barrel 26 to the total cross-sectional flow area of passages 54 and 55 is from about 6.5 to about 9.5, and the ratio of said total flow area to the total volume of both cell halves 32 and 34 is from about 0.2 to about 0.5. The materials of construction may be plastic, ceramic or other; however, moldable plastic such as temperature and oil resistant polyamide such as nylon, polycarbonate, polyester, polyimide, polyurethane or the like may be used.

Figure 6:
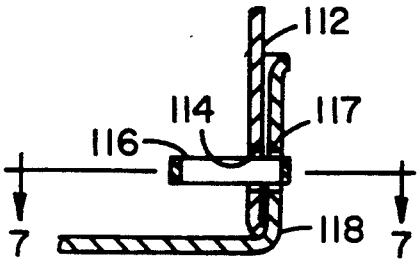
FIG. 6 is a cross-sectional view of the flanges of the motor cap and its mount showing a useful snap connection.
Figure 7:
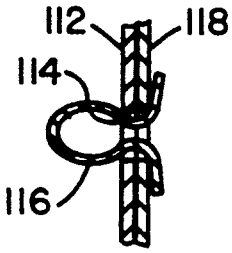
FIG. 7 is a cross-sectional view taken along line 7—7 of FIG. 6 in the direction of the arrows.

Referring to FIGS. 6 and 7, the metal motor cap 60 is provided with a flange 112, which in the embodiment shown is provided with a series of rectangular, oblong, round, or other configuration struck out apertures 114. Typically three to eight such apertures of a dimension e.g., of about one quarter inch diameter circular holes, suitably peripherally spaced are employed. These apertures receive locking clips 116 inserted through similar apertures 117 in the upturned flange 118 of the motor cap mounting means, the base 120 of which is secured to the top of the motor stator 122, e.g., by the stator assembly bolts or rivets 124. Many types of such snap-on fastening devices are known and useful in the present invention. After assembly of the cap, mounting means, conduits attenuator and compressor head, more permanent means such as screws may be employed to secure the motor cap to its mounting means should such be desired.

In assembling the present attenuator into a compressor unit, the cap 18 is frictionally, sealing forced into the body closure end to complete the attenuator assembly. The suction tubes 62, 64 which are already affixed at their ends 62(*a*) and 64(*a*), respectively, to the motor cap or suction plenum 60 are forced into sleeves 78, 80 of the attenuator and the cap 60 with attenuator attached then placed in position on the motor end by forcing conduit segments 72, 74 into their wells 88, 90 in the cylinder head 66. This simple assembly procedure can be carried out very rapidly and accurately and effects enhanced structural stability and sealing of the parts.

The invention has been described in detail with particular reference to preferred embodiments thereof, but it will be understood that variations and modification will be effected within the spirit and scope of the invention.

I claim:

1. A suction gas feed assembly for a gas compressor unit having shell means, electric motor driven dual piston compressor means mounted therein having dual suction porting means, one end of the motor being interconnected with and adjacent the compressor means, the other end of the motor being substantially unencumbered, said feed assembly comprising end cap means having circumferential side wall means and top wall means and adapted to be mounted within the shell means with said side wall means in substantial sealing contact with the said unencumbered end of the motor to provide suction plenum means substantially containing said unencumbered end, dual suction conduit means each having one of its ends mounted in aperture means in said side wall means of said end cap means, said aperture means being generally circumferentially spaced apart on said side wall means a distance of at least about one eighth of the total maximum circumferential dimension of said side wall means, one each of the other ends of said conduit means adapted to be mounted in communication with one each of the suction porting means of the compressor, intermediate portions of each of said conduit means lying between said one ends thereof and in adjacent relationship, housing means surrounding said intermediate portions and spaced therefrom to provide substantially closed attenuation cell means containing said intermediate portions, and gas passage means in each of said intermediate portions placing the same in fluid communication with said cell means.

2. The feed assembly of claim 1 wherein the said aperture means are spaced apart from about ¼ to about 1/7 of said circumferential dimension.

3. The feed assembly of claim 1 wherein the ratio of the net volume of the suction plenum means in cm$^3$ to the total cross-sectional area of both said conduit means in cm$^2$ is from about 200 to about 400.

4. The feed assembly of claim 1 wherein said housing means comprises a single jacket means containing the intermediate portions of each of said conduit means.

5. The feed assembly of claim 4 wherein said cell means is continuous.

6. The feed assembly of claim 1 wherein the ratio of the net volume of said suction plenum to the total volume of both said suction conduit means is from about 8 to about 30.

7. The feed assembly of claim 6 wherein the ratio is from about 14 to about 18.

8. The feed assembly of claim 1 wherein said cap means is provided with inlet aperture means adapted to place the suction plenum in direct and immediate fluid communication with the interior of the shell means and low pressure return gas therein.

9. The assembly of claim 1 wherein said aperture means are spaced apart a distance of from about one seventh to about one third of the total maximum circumferential dimension of said side wall means.

10. The assembly of claim 1 wherein said housing means and intermediate portions of said conduit means form a suction gas noise attenuator comprising an elongated, tubular body means having a base end and a closure end, base cap means on said base end, closure cap means on said closure end, both of said cap means and said body means forming an elongated, substantially closed attenuation cell means having major and minor transverse axes oriented substantially normally to each other, elongated wave modulating barrel means projecting from the inner side of said closure cap means and having major and minor transverse axes oriented substantially normally to each other, said barrel means being positioned within said cell means substantially longitudinally thereof with the major transverse axis of said barrel means being angularly offset from the major transverse axis of said cell means and substantially dividing said cell means into enlongated, substantially equal volume halves, socket means receiving a distal end portion of said barrel means and being formed in the interior surface of said base cap means and defined by floor means and sealing wall means surrounding the same and extending generally normally therefrom, sealing surface means on the distal end portion of said barrel means engaging said sealing wall means and forming a fluid seal therebetween, mating sealing shoulder means on said closure end of said body means and said closure cap means and forming a fluid seal therebetween, port means formed in said base cap means and extending through said floor means, gas passage means formed in said closure cap means and barrel means generally longitudinally thereof, said port means and passage means being in fluid communication across said floor means, and damping vent means in the wall of said barrel means placing said passage means into fluid communication with each half of said cell means.

11. A gas compressor unit having shell means, electric motor driven dual piston compressor means mounted therein having dual suction porting means, said motor being interconnected with said compressor means at one end and substantially free at its other end, end cap means having side wall means and top wall means and mounted within said shell means with said side wall means in substantial sealing contact with the free end of the motor to provide a suction plenum means substantially containing the free end, dual suction conduit means each having one of its ends mounted in aperture means in said side wall means of said end cap means, said aperture means being spaced apart substantially circumferentially in said side wall means a distance of at least about one eighth the total circumferential dimension of said side wall means, the other ends of said conduit means being mounted in communication with said suction porting means, intermediate portions of each of said conduit means lying between said one ends thereof and in adjacent relationship separated only by wall means housing means surrounding said intermediate portions and spaced therefrom to provide substantially closed attenuator cell means containing said intermediate portions, and gas passage means in each of said intermediate portions placing each of said conduit means in fluid communication with said cell means.

12. The unit of claim 11 wherein said aperture means are spaced apart from about ¼ to about 1/7 of said circumferential dimension.

13. The unit of claim 12 wherein said housing means comprises a single jacket means containing the intermediate portions of each of said conduit means.

14. The unit of claim 13 wherein said cell means is continuous.

15. The unit of claim 11 wherein the ratio of the net volume of the suction plenum means in $cm^3$ to the total cross-sectional area of both said conduit means in $cm^2$ is from about 250 to about 350.

16. The unit of claim 15 wherein the ratio the net volume of said suction plenum of the total volume of both said suction conduit means is from 12 to about 25.

17. The unit of claim 9 wherein the ratio of the net volume of said suction plenum to the total volume of both said suction conduit means is from about 13 to about 25.

18. The unit of claim 11 wherein said cap means is provided with inlet aperture means placing the suction plenum in direct and immediate fluid communication with the interior of the shell means for receiving low pressure return gas therein.

19. The unit of claim 9 wherein said cap means is secured to the free end face of the motor stator.

20. The unit of claim 19 wherein said cap means comprises a separate base ring and shroud, said ring being affixed to said stator end face, and said shroud being affixed to said ring.

* * * * *